US006379502B1

(12) United States Patent
Satzger et al.

(10) Patent No.: US 6,379,502 B1
(45) Date of Patent: Apr. 30, 2002

(54) PROCESS AND DEVICE FOR TRANSFERRING A TRAVELING MATERIAL WEB

(75) Inventors: Oswald Satzger, Giengen; Zygmunt Madrzak; Karlheinz Straub, both of Heidenheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/473,143

(22) Filed: Dec. 28, 1999

(30) Foreign Application Priority Data

Jan. 13, 1999 (DE) ..... 199 00 986

(51) Int. Cl.[7] ..... B65H 19/26; B65H 19/28; D21F 1/36; D21F 7/00; D21G 9/00

(52) U.S. Cl. ..... 162/193; 162/194; 162/255; 162/286; 226/7; 226/91; 83/53; 83/177; 34/117

(58) Field of Search ..... 162/193–194, 162/255, 286, 198, 199, 263, 264, 275, 272; 34/114, 117, 120; 83/177, 153, 402; 226/7, 91, 97.3

(56) References Cited

U.S. PATENT DOCUMENTS

| | | | | |
|---|---|---|---|---|
| 4,445,646 A | | 5/1984 | Karr et al. | |
| 5,762,759 A | * | 6/1998 | Wedel | 162/193 |

FOREIGN PATENT DOCUMENTS

| | | | |
|---|---|---|---|
| EP | 543788 | | 5/1993 |
| GB | 1338440 | | 11/1973 |
| WO | 91/03359 | * | 3/1991 |
| WO | 97/48632 | | 12/1997 |
| WO | 98/33974 | | 8/1998 |

* cited by examiner

*Primary Examiner*—Jose Fortuna
(74) *Attorney, Agent, or Firm*—Greenblum & Bernstein, P.L.C.

(57) ABSTRACT

Process and apparatus for transferring a traveling material web into a target region. The process includes positioning at least two cutting mechanisms at one of a same and different width positions between web edges of a traveling material web. The at least two cutting mechanisms are movable relative to the traveling material web in a plane approximately parallel to the material web. The process also includes cutting the traveling material web at the one of the same and different width positions, thereby forming at least one resulting cut that extends approximately parallel to a web travel direction, and forming a substantially pointed beginning of a transfer strip by moving at least one of the at least two cutting mechanisms in a direction toward one of the web edges from its respective width position. In this manner, the resulting cuts of the at least two cutting mechanisms occur at one of a same and a substantially close proximity to a same width position. The apparatus includes at least two cutting mechanisms which are movable relative to the traveling material web in a plane approximately parallel to traveling material web, and the at least two cutting mechanisms are positioned to cut a transfer strip that extends approximately parallel to a web travel direction. The at least two cutting mechanisms are positionable at one of a same and different width positions between web edges of the traveling material web to produce at least one resulting cut in the traveling material web, and at least one of the at least two cutting mechanisms is movable toward an edge of the traveling web to form a pointed beginning of a transfer strip. In this manner, the resulting cuts of the at least two cutting mechanisms occur at one of a same and a substantially close proximity to a same width position.

35 Claims, 3 Drawing Sheets

PROCESS AND DEVICE FOR TRANSFERRING A TRAVELING MATERIAL WEB

CROSS-REFERENCE TO RELATED APPLICATIONS

The present application claims priority under 35 U.S.C. §119 of German Patent Application No. 199 00 986.4, filed on Jan. 13, 1999, the disclosure of which is expressly incorporated by reference herein in its entirety.

BACKGROUND OF THE INVENTION

1. Field of the Invention

The present invention relates to a process for transferring a traveling material web, e.g., a paper web, into a target region, e.g., onto a target roll, in which a transfer strip that extends approximately parallel to a travel direction of the material web is cut in the traveling material web by at least two cutting mechanisms that can be moved relative to the material web in a plane that is approximately parallel to material web.

The present invention also relates to a device for transferring a traveling material web, e.g., a paper web, having at least two cutting mechanisms that can be moved relative to the material web in a plane approximately parallel to the material web, which are adapted to cut a transfer strip that extends approximately parallel to the travel direction of the material web.

2. Discussion of Background Information

Processes and devices of the type generally discussed above are used, e.g., in paper manufacturing to supply the new web beginning to a target roll, e.g., when a paper machine is being started up or after the paper web tears. The target roll is formed as, e.g., a web guide roll either that deflects the paper web or onto which the paper web is to be wound.

International Publication No. WO 98/33974 discloses a process and a device for producing an insertion strip in a paper machine. This document discloses cutting a narrow edge strip in the web by one of two cutting devices and then moving the cutting device together with another cutting device toward a middle of the web. As a result, the web is cut starting from the web edge by the second cutting device. Thus, the free edge strip is produced and conveyed into a pulper while the insertion strip is blown onto a conveyor device that extends laterally to the web. However, this document does not disclose how the beginning of the insertion strip is produced.

International Publication No. WO 97/48632 discloses using two cuts that start approximately from a center of a paper web and which end at opposite web edges. The cuts are produced by a water jet that is discharged by a movable nozzle so as to broaden out the new web beginning without producing a transfer strip. The cuts can have a common starting point so that the web is completely severed. Then, strip-shaped adhesive surfaces are applied either to the new web beginning or to a roll onto which the paper web is to be wound so that the new web beginning adheres when it touches the roll.

SUMMARY OF THE INVENTION

The present invention provides a process and a device of the type mentioned generally discussed above which also permits as simple and reliable as possible a transfer of the traveling material web.

In particular, the process also includes cutting a pointed beginning of the transfer strip. In this regard, at least one of the cutting mechanisms is moved in the direction of one of the web edges from a width position of the cutting mechanisms. In this way, cuts are produced that are at least approximately identical or which can extend at least in close proximity to each other with respect to a width position.

Due to the at least approximately identical width position of the cutting mechanisms, the present invention permits the cuts, which are produced by the cutting mechanisms, to coincide or at least to extend in close proximity to one another either at a point or over a particular length. Thus, the beginning of the transfer strip can be cut out of the traveling material web so that a free strip beginning is produced which can be easily supplied to the target region.

Another essential advantage of the present invention is that a same width position can be selected in a basically arbitrary fashion so that the strip beginning can be cut out at an arbitrary location across the width of the material web. Thus, according to the instant invention, one is not limited to a conveyor device located next to the material web, such as a cable pull. The conveyor device for the transfer strip can therefore also be disposed, e.g., in the center of the material web.

The present invention permits an optimal matching of both the position and the width of the transfer strip to a concrete design of the conveyor device and to the plane in which the conveyor device is located. In this way, it can be particularly advantageous for the matching to be reproducible. Furthermore, the invention permits the cutting of the transfer strip to start inside the material web, i.e, it is not necessary start the cutting from one of the web edges. Thus, the present invention eliminates the need to produce a free edge strip, which must be carried out in a definite manner at a comparatively high cost and must, e.g., be blown into the pulper.

According to an exemplary embodiment of the invention, the cutting mechanism(s) can be moved such that cuts produced by the cutting mechanisms cross over each other.

In this way, the beginning of the transfer strip can be cut out from the material web, and the cutting mechanisms can switch positions, i.e., viewed in terms of the width of the material web. Further advantages can be found in that, in the event that a preceding transfer attempt has failed, recutting of a strip beginning can be made by switching (exchanging) positions of the cutting mechanisms, which avoids a time-consuming return of the cutting mechanisms into a starting position. Furthermore, before cutting the transfer strip, i.e, before producing the criss-crossing cuts, a leader strip that precedes the transfer strip can be cut in the material web using the two cutting mechanisms. A significant advantage of the invention is that the end of the leader strip is completely cut out or separated by the criss-crossing cuts, i.e, is severed from the new web beginning. According to the invention, this severing of the leader strip, which is also referred to as severing of the remainder strip, is carried out automatically using the beginning of the transfer strip.

According to another exemplary embodiment of the invention, the cutting mechanisms can be moved so that cuts at the strip beginning produced by the cutting mechanisms, e.g., at the tip of the strip, are routed past one another at close proximity in such a way that an intended tear point is produced.

In this way, an automatic production of a free beginning of the transfer strip can be performed without requiring the execution of cuts, e.g., which cross one another or which start from a single cut in order to cut out the strip beginning.

According to another exemplary embodiment of the invention, the strip beginning can be supplied to the target region and/or to a conveyor device at least essentially immediately after the cutting of the transfer strip is begun.

This procedure actually becomes possible due to the fact that the beginning of the transfer strip is cut out of the material web. One advantage of the early manipulation of the strip beginning is that, as a result, the transfer strip can be moved at least approximately along an ideal web travel path between the cutting mechanisms and the target region along which web travel path, e.g., the material web is guided during normal operation.

The present invention also provides a device to cut a pointed beginning of the transfer strip in which at least one of the cutting mechanisms can be moved in the direction of one of the web edges from a width position of the cutting mechanisms. The moving width position produces cuts that are at least approximately identical and at least extend in close proximity to the cuts of the other cutting mechanism.

The present invention is directed to a process for transferring a traveling material web into a target region. The process includes positioning at least two cutting mechanisms at one of a same and different width positions between web edges of a traveling material web. The at least two cutting mechanisms are movable relative to the traveling material web in a plane approximately parallel to the material web. The process also includes cutting the traveling material web at the one of the same and different width positions, thereby forming at least one resulting cut that extends approximately parallel to a web travel direction, and forming a substantially pointed beginning of a transfer strip by moving at least one of the at least two cutting mechanisms in a direction toward one of the web edges from its respective width position. In this manner, the resulting cuts of the at least two cutting mechanisms occur at one of a same and a substantially close proximity to a same width position.

In accordance with a feature of the present invention, the resulting cuts of the at least two cutting mechanisms at the strip beginning can have a common starting point. Further, the common starting point may be at a downstream tip of the transfer strip relative to the web travel direction.

According to another feature of the instant invention, the resulting cuts of the at least two cutting mechanisms can cross each other.

Before forming the substantially pointed beginning of the transfer strip, the at least two cutting mechanisms can form only a single cut. Further, the single cut may extend approximately parallel to the web travel direction.

The at least two cutting mechanisms may be coupled for rotation about an axis normal to the traveling material web. The at least two cutting mechanisms can be positionable into different width positions, and, when rotated around the axis by approximately 90°, the at least two cutting mechanisms may be positionable in a same width position.

According to still another feature of the invention, at the strip beginning, the resulting cuts produced by the at least two cutting mechanisms may be guided in close proximity to one another, thereby forming an intended tear point. The tear point may be formed at the tip of the strip.

In accordance with a further feature of the present invention, the transfer strip can be cut approximately from the center of the traveling material web.

As a further feature of the instant invention, the transfer strip can be formed to have a width which is small relative to a width of the traveling material web and which can be at least approximately constant.

After the formation of the transfer strip, the process may further include moving the at least two cutting mechanisms away from each other in directions toward the web edges.

In accordance with another feature of the invention, the at least one cutting mechanism may be movable essentially cross-wise to the web travel direction.

The process can further include cutting a leader strip prior to forming the transfer strip. The leader strip may be parallel to the web travel direction and may be positioned in close proximity to one of the web edges.

According to a still further feature of the instant invention, remaining portions of the traveling material web located adjacent to the transfer strip may be guided into one of a machine basement and pulper of a paper machine.

The process may further include supplying the transfer strip to at least one of the target region and a conveyor device at least essentially immediately after the forming of the pointed beginning of the transfer strip.

Moreover, the process can also include moving the transfer strip at least approximately along an ideal web travel path between the at least two cutting mechanisms and the target region.

According to another feature of the invention, the traveling material web may be cut in a supported region. The support region can be formed by at least one of a roll and a wire.

In accordance with still another feature, the traveling material web may be cut in an unsupported region. The unsupported region may be a free draw located immediately before a roll.

The at least two cutting mechanisms can include nozzles for discharging a fluid jet. The fluid jet may include a water jet, and the fluid jet may be discharged obliquely to a direction normal of the traveling material web.

In accordance with another feature of the invention, the traveling material web can be composed of a paper web.

According to yet another feature, the target region can include a target roll.

The present invention is directed to an apparatus for transferring a traveling material web. The apparatus includes at least two cutting mechanisms which are movable relative to the traveling material web in a plane approximately parallel to traveling material web, and the at least two cutting mechanisms are positioned to cut a transfer strip that extends approximately parallel to a web travel direction. The at least two cutting mechanisms are positionable at one of a same and different width positions between web edges of the traveling material web to produce at least one resulting cut in the traveling material web, and at least one of the at least two cutting mechanisms is movable toward an edge of the traveling web to form a pointed beginning of a transfer strip. In this manner, the resulting cuts of the at least two cutting mechanisms occur at one of a same and a substantially close proximity to a same width position.

According to a feature of the instant invention, the at least two cutting mechanisms are movable independently of each other.

In accordance with another feature of the invention, the at least two cutting mechanisms can be positioned with an approximately constant spacing in the web travel direction, and may be movable along a common axis cross-wise to the web travel direction.

The at least two cutting mechanisms can be located on a common carrier which extends across the traveling material web in a cross-wise direction.

Moreover, the at least two cutting mechanisms may be rotatable around an axis that extends approximately normal to the traveling material web.

Further, the at least two cutting mechanisms can include at least one nozzle for discharging a fluid jet. The fluid jet can include a water jet, and the fluid jet may be discharged obliquely to a direction normal of the traveling material web.

According to yet another feature of the instant invention, the apparatus can form a component of one of a drying section, a wet section, a coating unit, and an end group of a paper machine.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1A:
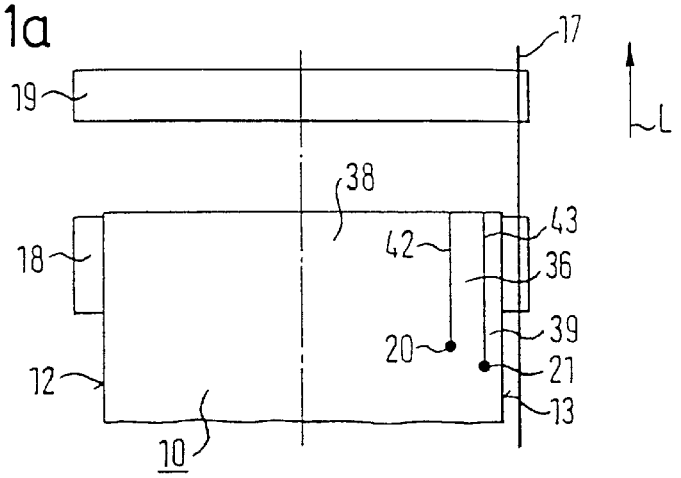
FIGS. 1A–1C schematically illustrate different phases of a cutting process for forming a transfer strip in accordance with an exemplary embodiment of the invention.

FIG. 1A illustrates a material web 10 guided over a roll 18 which is followed in the web travel direction L by another roll 19. In the state shown in FIG. 1A, the material web 10 travels between rolls 18 and 19, e.g., into a machine basement or into a pulper of the paper machine with which rolls 18 and 19 are associated. The present invention assists in supplying roll 19 with a new web beginning formed from traveling material web 10. Consequently, roll 19 can be called a target roll. This will generally be referred as a target region for the new web beginning.

In order to cut a transfer strip in material web 10, a cutting device, which includes two cutting mechanisms 20 and 21, is provided. Cutting mechanisms 20 and 21 are only schematically depicted by circles in FIGS. 1A–1C, and are, e.g., nozzles for discharging a water jet in a direction diagonally or obliquely to a direction normal to material web 10. This inclination of the nozzles ensures that neither the strip itself nor the new web beginning is damaged by the water. Moreover, instead of nozzles that discharge fluid, other cutting devices can also be utilized, e.g., rotating, preferably serrated, circular blades, fixed blades, needles, or lasers.

Cutting mechanisms 20 and 21 can be moved and operated independently of one another, so that movement of cutting mechanisms 20 and 21 relative to material web 10 occurs in a transverse direction of or cross-wise to web travel direction L. Cutting mechanisms 20 and 21 can be arranged on a common carrier which extends across material web 10, or on separate carriers can be provided for cutting mechanisms 20 and 21.

Figure 1B:
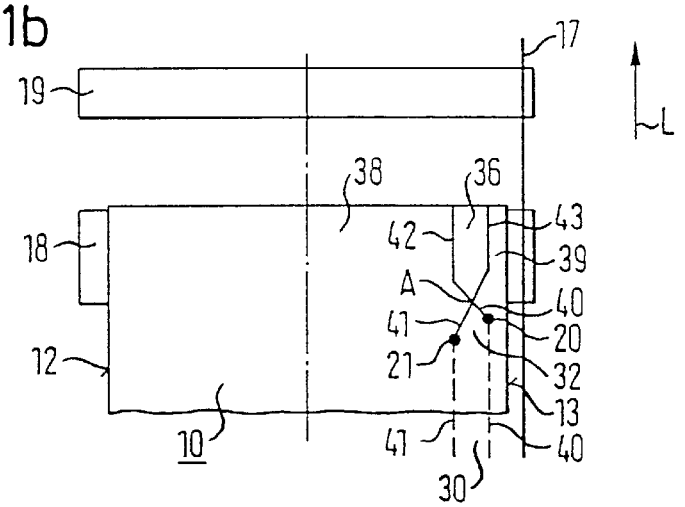
Figure 1C:
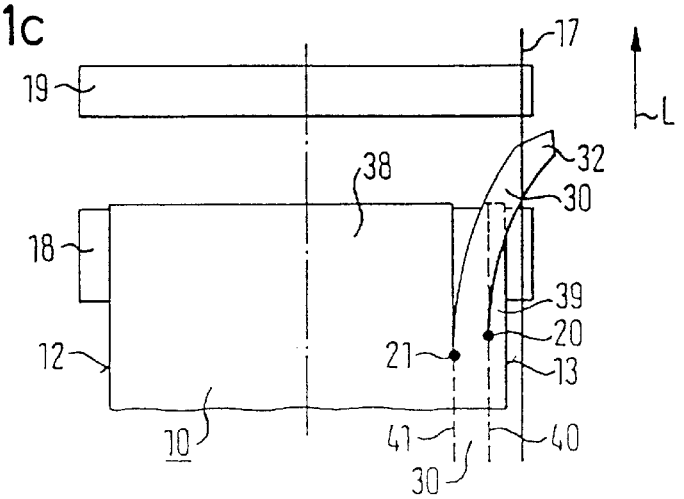

As can be seen in FIGS. 1A–1C, cutting mechanisms 20 and 21 can be arranged to be offset from one another in web travel direction L. This arrangement facilities movement of cutting mechanisms 20 and 21 past one another in the transverse or cross-wise direction.

As depicted in FIG. 1A, two cuts 42 and 43, which are arranged to extend parallel to web travel direction L, have already been made or produced in material web 10 in a vicinity of web edge 13. In this manner, a narrow strip 36 is produced, which can be referred to as the leader strip. Leader strip 36 can be located between a narrow edge strip 39 and the rest of material web 10, which can be referred to as the wide edge strip 38.

Material web 10, which has been cut by both cutting mechanisms 20 and 21, is conveyed through and between rolls 18 and 19 so that leader strip 36 and the two edge strips 38 and 39 are automatically conveyed together into, e.g., the machine basement or into the pulper. With regard to conveying the strips to the machine basement or pulper, no particular measures are performed for this purpose.

To cut leader strip 36, cutting mechanisms 20 and 21 can be placed against material web 10 so that, starting from respective web edges 12 and 13, they are moved toward one another until a desired transverse spacing, i.e., strip width, is attained. In this way, cutting mechanisms 20 and 21 reach desired width positions so that material web 10 can be cut into from both web edges 12 and 13. As an alternative, material web 10 can also be cut into with only one of cutting mechanisms 20 or 21, or can be cut into with both of cutting mechanisms 20 and 21 starting from a same web edge 12 or 13. Furthermore, it may also be possible to place cutting mechanisms 20 and 21 in the face or middle of material web 10 without an incision beginning at web edges 12 or 13, to, consequently, begin cutting leader strip 36 at the desired width position. Finally, only one of cutting mechanisms 20 and 21 could be placed in the face of material web 10, and the respective other cutting mechanism 20 and 21 can cut into material web 10 starting from one of web edges 12 and 13.

A conveyor 17, which extends laterally to material web 10 in a vicinity of the ends of rolls 18 and 19, and parallel to web travel direction L, can be formed, e.g., as a cable pull, which will be more fully described with regard to FIG. 1C.

After a particular length of leader strip 36 is achieved or formed, cutting mechanisms 20 and 21, which are arranged offset from each other in web travel direction L, can be moved toward and past each other in the cross-wise direction to web travel direction L. In this manner, the cuts produced by cutting mechanisms 20 and 21 cross over one another and, thus, cutting mechanisms 20 and 21 substantially switch or exchange their width positions. Thus, cutting mechanisms 20 and 21 may be initially moved into a common width position and, starting from this common width position, can be moved in the direction of web edges 12 and 13 to produce cuts 43 and 41, and 42 and 40, respectively, that cross one another. As a result, cuts 40 and 41 adjoining a common starting point A, at which the cuts cross one another, form a pointed beginning 32 of transfer strip 30 to be cut. The course of transfer strip 30 is indicated in FIGS. 1B and 1C in dashed lines. In this manner, a free beginning 32 of transfer strip 30 is produced or formed, and common starting point A of cuts 40 and 41 determines or defines a position of the tip of transfer strip 30, which is at the front or lead in web travel direction L.

A particular advantage of the instant invention is that, as a result of the crossing of the cuts, i.e., cuts 43 and 41, and 42 and 40, the end of leader strip 36 is cut out of material web 10 and is completely severed from transfer strip 30. Consequently, the invention provides for automatic severance of the remaining strip.

According to FIG. 1C, free strip beginning 32 of transfer strip 36 can be supplied to conveyor 17, which catches or engages strip beginning 32 and transports it in a direction of the target region. Edge strips 38 and 39 of material web 10 continue to be conveyed through and between rolls 18 and 19. Thus, special device for manipulating narrow edge strip 39 are not required by the present invention.

At a desired time, e.g., when transfer strip 30 is traveling in a stable manner toward the target region, cutting mechanisms 20 and 21 can be moved away from each other and toward respective web edge 12 or 13. In this manner, transfer strip 30 can be widened to produce a new web beginning that extends across the entire web width. As soon as the full width of material web 10 has been conveyed into the target region, the transfer process is complete. Further, as soon as cutting mechanisms 20 and 21 have reached web edges 12 and 13, i.e., after the widening, material web 10 is completely cut and remaining strips 38 and 39 will travel automatically and with no difficulty into either the machine basement or the pulper.

FIGS. 2A–2F schematically illustrates various alternative cutting possibilities for forming or cutting beginning 32 of transfer strip 30. The positions of cutting mechanisms 20 and 21, as well as cutting mechanism 22 depicted in FIG. 2F, the cutting of strip beginning 32 are indicated with the reference numerals 20', 21', 22'.

Figure 2A:
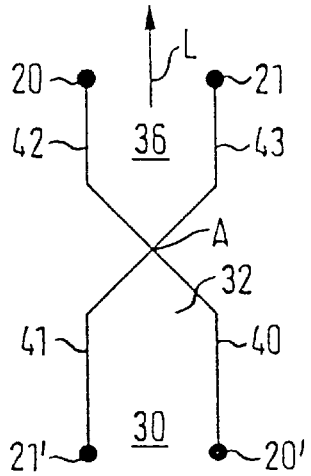
FIGS. 2A–2F schematically illustrate alternative arrangements for producing cuts for forming a transfer strip.

FIG. 2A illustrates the cutting arrangement depicted in FIGS. 1A–1C, where cuts 42 and 40, and 43 and 41, respectively, produced by cutting mechanisms 20 and 21 cross one another through movement of both cutting mechanisms 20 and 21. The width of leader strip 36 thereby corresponds to the width of transfer strip 30. Crossing point A, where cuts 40 and 41 begin, form strip beginning 32. The width positions of cutting mechanisms 20 and 21 are substantially switched or exchanged by crossing over.

Figure 2B:
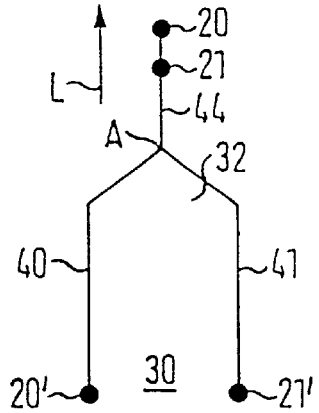

A leader strip, which is located ahead of transfer strip 30 to be cut, is not cut in the embodiment according to FIG. 2B. Instead, cuts 40 and 41, which form beginning 32 of transfer strip 30, originate at starting point A from a single cut 44. During the production of cut 44, cutting mechanisms 20 and 21 are located at a same width position, i.e., aligned in web travel direction L, such that front cutting mechanism 20 in web travel direction L travels in cut 44 produced by other cutting mechanism 21. In this embodiment, both cutting mechanisms 20 and 21 are moved out from this common width position in order to produce a strip beginning 32 which symmetrically tapers off to starting point A.

Figure 2C:
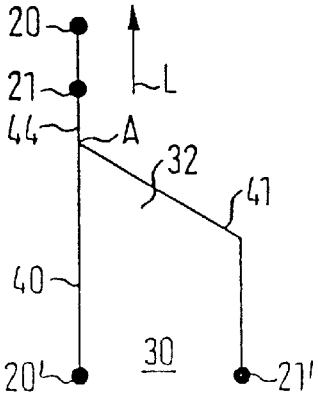

The exemplary embodiment depicted in FIG. 2C differs from that depicted in FIG. 2B in that only cutting mechanism 21 is moved out of the common width position of cutting mechanisms 20 and 21 in order to cut strip beginning 32. This produces a strip beginning 32 which tapers off asymmetrically.

Figure 2D:
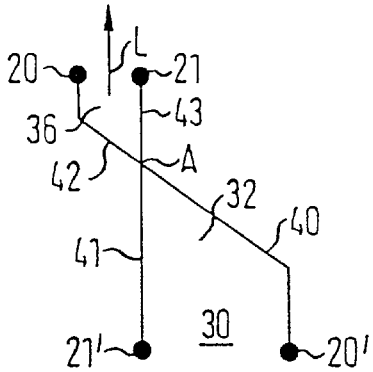

FIG. 2D illustrates an alternative embodiment in which leader strip 36 is cut, however, in contrast to the embodiment depicted in FIG. 2A, only cutting mechanism 20 is moved transversely or cross-wise to web travel direction L. Other cutting mechanism 21 consequently produces a straight cut 43 and 41 that extends parallel to web travel direction L. This embodiment also produces an asymmetrically tapering strip beginning 32. Consequently, leader strip 36 and transfer strip 30, which are severed at starting point A of cuts 40 and 41, extend offset from each other in the transverse direction.

Figure 2E:
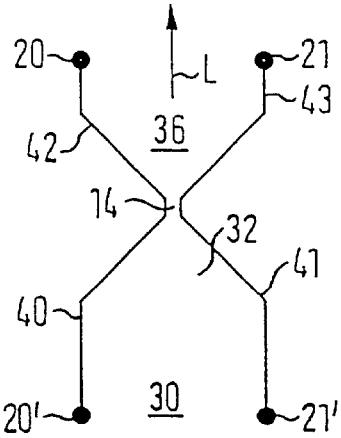

The process according to FIG. 2E differs from other discussed embodiments in that cuts 43 and 41, and 42 and 40 produced by cutting mechanisms 20 and 21 do not have a common point in the vicinity of strip beginning 32. Instead, the cuts are guided in close proximity toward one another, i.e., without crossing, in such a way that a short, narrow material connector remains which constitutes an intended tear point 14. The size of tear point 14 and, in particular, the minimal spacing of the cuts are set as a function of the properties of material web 10. Consequently, cutting mechanisms 20 and 21 do not occupy an exactly identical width position, but rather, in order to produce intended tear point 14, are first moved toward each other into an almost identical width position and are then moved away from each other, i.e., out of the width position. Intended tear point 14 is formed so that material web 10 automatically tears there by itself so that in this embodiment a free beginning 32 of transfer strip 30 is produced and a severance of leader strip 36 is simultaneously achieved.

Figure 2F:
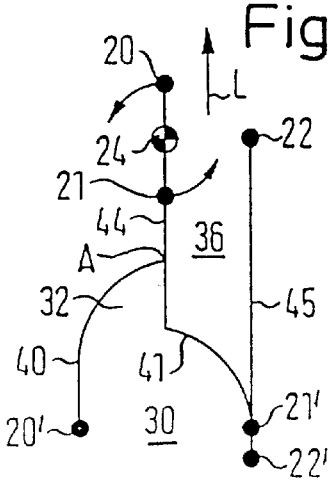

In the embodiment according to FIG. 2F, three cutting mechanisms 20, 21, and 22 are provided in which cutting mechanisms 20 and 21 are spaced apart in web travel direction L but are positioned at a same width position before cutting of transfer strip 30 to form a single cut 44. Third cutting mechanism 22 is provided cut 45 which forms the opposite edge of leader strip 36 and which extends parallel to cut 44. Further, cut 45 can be positioned close to one of the web edges.

Cutting mechanisms 20 and 21 can be components of a so-called "revolver nozzle" apparatus and can be respectively arranged with a constant spacing from a rotational axis 24, which extends normal to the plane defined by material web 10. Cutting mechanisms 20 and 21 can, thereby, be jointly rotated around axis 24, as indicated by the arrows. By rotating around axis 24, cutting mechanisms 20 and 21 can be moved out from the same width position to produce web beginning 32, which is formed by cuts 40 and 41, which originate from common starting point A. In the exemplary embodiment of FIG. 2F, the distance between rotational axis 24 and cutting mechanism 21 corresponds to the width of leader strip 36 so that, after rotating revolver nozzle apparatus by 90°, cuts 41 and 45 produced by cutting mechanisms 21 and 22 coincide.

Figure 3:
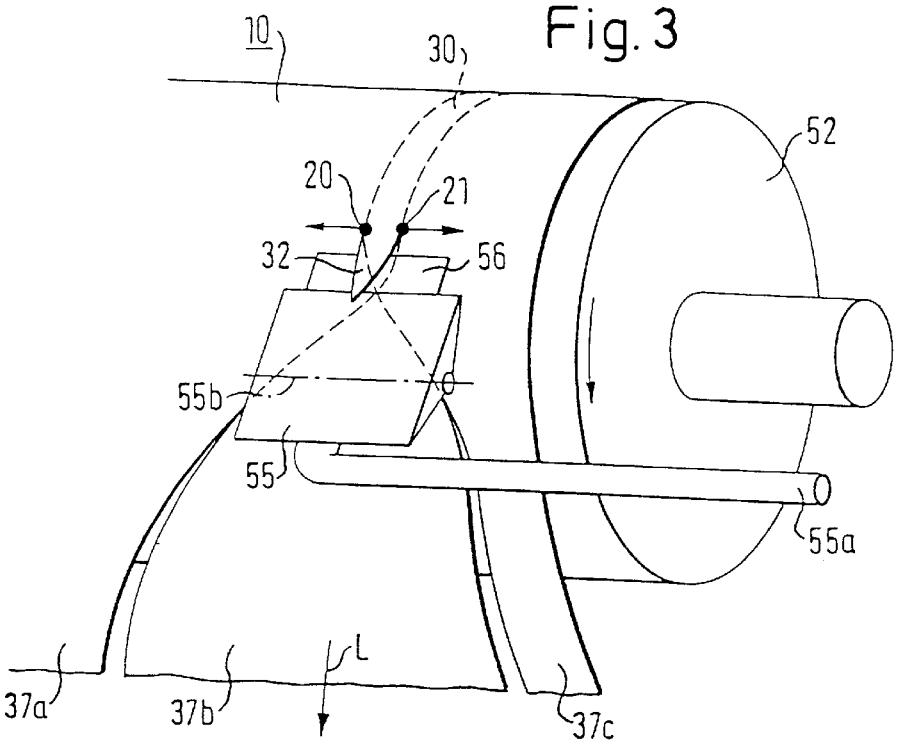
FIG. 3 illustrates a partial, schematic view of a doctor which is disposed on a roll for guiding the beginning of the transfer strip.

FIG. 3 illustrates an exemplary embodiment for removing cut-free beginning 32 of transfer strip 30, which is indicated with dashed lines out from the surface defined by traveling material web 10. A doctor 55 equipped with a blade 56 can be utilized for this purpose. Doctor 55 can be rotatable around an axis 55*b* via an adjusting mechanism 55*a* so as to adjust the pressure against roll 52, e.g., a last drying roll of a drying section of the paper machine. The contact pressure in this regard is adjusted to be low so that the travel of material web 10 is not impaired and material web 10 is allowed to pass through in an unhindered fashion between roll 52 and blade 56. Beginning 32 of transfer strip 30, which is cut out by cutting mechanisms 20 and 21 located in front of blade 56 in web travel direction L, is caught by blade 56 and can be deflected in the desired direction via doctor 55 and, if need be, can also be supplied to the target region by other conveyor devices (not shown). Leader section 37*b*, which is produced by the crossing over of the cuts produced by cutting mechanisms 20 and 21 and is free on the rear end in web travel direction L, can be conveyed along with edge sections 37*a* and 37*c* of material web 10 into either the machine basement or the pulper.

Figure 4:
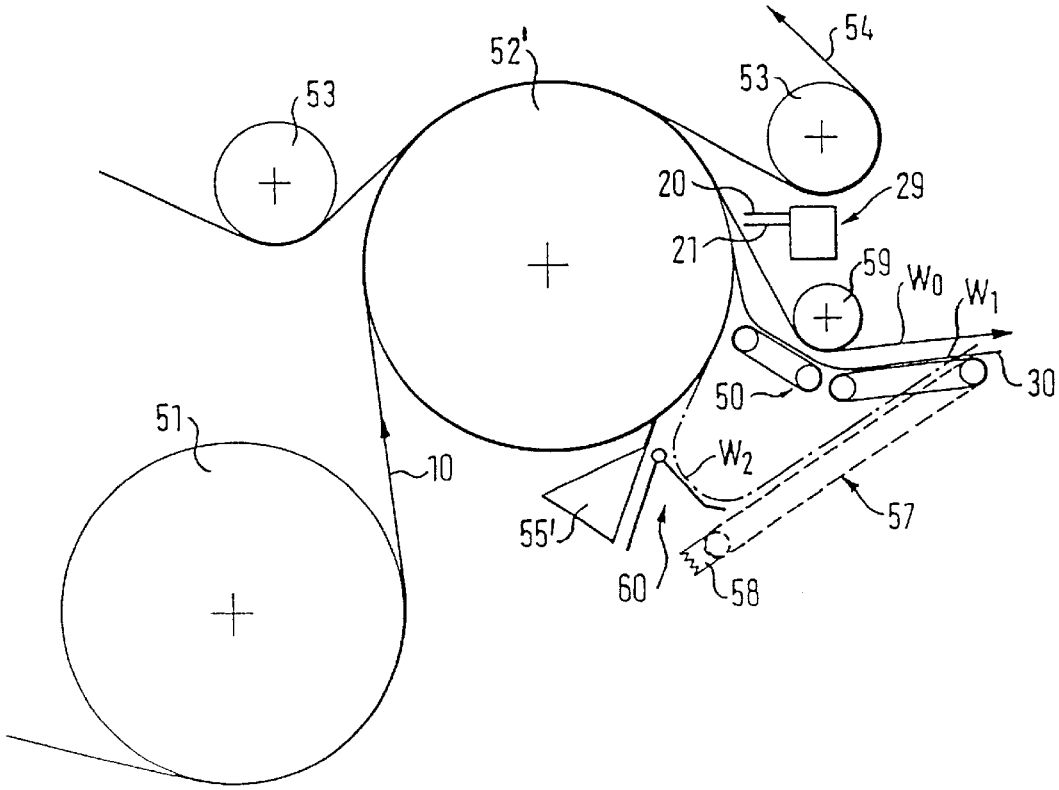
FIG. 4 illustrates a schematic side view of a portion of a drying section of a paper machine used in combination with the present invention.

Another advantage of the present invention is shown in FIG. 4. Material web 10, which is conveyed via a roll 51, can be cut by cutting device 29, which includes cutting mechanisms 20 and 21, in a region supported by a drying roll 52', in which material web 10 is no longer in contact with a wire 54 guided by rolls 53.

$W_0$ indicates the ideal web travel path along which material web 10 travels during normal operation. The course of this ideal path $W_0$ is determined by a deflecting roll 59, among other things. Because the beginning of transfer strip 30 is cut out from material web 10 according to the present invention, the beginning is free and can be caught by suitable elements immediately after being produced and can be supplied, for example, to conveyor device 50 shown in FIG. 4 which includes two endless conveyors, and can be transported by this into the target region.

Through the early, definite guidance of the beginning of transfer strip 30 according to the invention, transfer strip 30 and consequently the new web beginning can be moved along a web travel path $W_1$, which extends in close proximity to ideal path $W_0$. Because transfer strip 30 is free from the beginning according to the invention, the new web beginning does not need to be guided by a doctor 55' and a deflecting mechanism 60 along significantly longer path $W_2$ indicated by a dot-and-dashed line in FIG. 4. Path W2 was previously required in order to cut the strip beginning free, e.g., by a cutting device 57 with a knife 58. The tightening or so-called catching up of transfer strip 30, i.e., to assume ideal path $W_0$, can be achieved according to the invention in a significantly shorter time since lower path $W_2$ is significantly longer than almost ideal path $W_1$.

Fundamentally, cutting device 29 can also be located at another location in the paper machine, in which material web 10 can also be cut in a region supported by a wire or in unsupported region, e.g., in a free draw.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 material web
12, 13 web edges
14 intended tear point
17 conveyor, cable pull
18, 19 rolls
20, 21, 22 cutting mechanisms
20', 21', 22' positions
24 rotational axis
29 cutting device
30 transfer strip
32 beginning of transfer strip
36 leader strip
37*b* leader section
37*a, c* edge section
38, 39 edge strip
40, 41 cuts for transfer strip
42, 43 cuts for leader strip
44, 45 cuts
50 conveyor device
51 roll
52, 52' drying roll
53 roll
54 wire
55, 55' doctor
55*a* adjusting mechanism
56 blade
57 cutting device
58 knife
59 deflecting roll
60 deflecting mechanism
A starting point
L web travel direction
$W_0$ ideal web travel path
$W_1$ almost ideal web travel path
$W_2$ longer web travel path

What is claimed:

1. A process for forming a transfer strip for transferring a traveling material web into a target region, comprising:

positioning, prior to cutting, at least two cutting mechanisms at one of a same and different width positions between web edges of a traveling material web, the at least two cutting mechanisms being movable relative to the traveling material web in a plane approximately parallel to the material web;

cutting the traveling material web at the one of the same and different width positions, thereby forming at least one resulting cut that extends approximately parallel to a web travel direction;

forming a substantially pointed beginning of a transfer strip by moving at least one of the at least two cutting mechanisms in a direction toward one of the web edges from its respective width position, whereby the resulting cuts of the at least two cutting mechanisms occur at one of a same and a substantially close proximity to a same width position.

2. The process in accordance with claim 1, wherein the resulting cuts of the at least two cutting mechanisms at the strip beginning have a common starting point.

3. The process in accordance with claim 2, wherein the common starting point is at a downstream tip of the transfer strip relative to the web travel direction.

4. The process in accordance with claim 1, wherein the resulting cuts of the at least two cutting mechanisms cross each other.

5. The process in accordance with claim 1, wherein before forming the substantially pointed beginning of the transfer strip, the at least two cutting mechanisms form only a single cut.

6. The process in accordance with claim 5, wherein the single cut extends approximately parallel to the web travel direction.

7. The process in accordance with claim 1, wherein the at least two cutting mechanisms are coupled for rotation about an axis normal to the traveling material web.

8. The process in accordance with claim 7, wherein the at least two cutting mechanisms are positionable into different width positions, and, when rotated around the axis by approximately 90°, the at least two cutting mechanisms are positionable in a same width position.

9. The process in accordance with claim 1, wherein at the strip beginning, the resulting cuts produced by the at least two cutting mechanisms are guided in close proximity to one another, thereby forming an intended tear point.

10. The process in accordance with claim 9, wherein the tear point is formed at the tip of the strip.

11. The process in accordance with claim 1, wherein the transfer strip is cut approximately from the center of the traveling material web.

12. The process in accordance with claim 1, wherein the transfer strip is formed to have a width which is small relative to a width of the traveling material web and which is at least approximately constant.

13. The process in accordance with claim 1, wherein after the formation of the transfer strip, the process further comprises:

moving the at least two cutting mechanisms away from each other in directions toward the web edges.

14. The process in accordance with claim 1, wherein the at least one cutting mechanism is movable essentially cross-wise to the web travel direction.

15. The process in accordance with claim 1, further comprising:

cutting a leader strip prior to forming the transfer strip, wherein the leader strip is parallel to the web travel direction and is positioned in close proximity to one of the web edges.

16. The process in accordance with claim 1, wherein remaining portions of the traveling material web located adjacent to the transfer strip are guided into one of a machine basement and pulper of a paper machine.

17. The process in accordance with claim 1, further comprising:

supplying the transfer strip to at least one of the target region and a conveyor device at least essentially immediately after the forming of the pointed beginning of the transfer strip.

18. The process in accordance with claim 1, further comprising:

moving the transfer strip at least approximately along an ideal web travel path between the at least two cutting mechanisms and the target region.

19. The process in accordance with claim 1, wherein the traveling material web is cut in a supported region.

20. The process in accordance with claim 19, wherein the support region is formed by at least one of a roll and a wire.

21. The process in accordance with claim 1, wherein the traveling material web is cut in an unsupported region.

22. The process in accordance with claim 21, wherein the unsupported region is a free draw located immediately before a roll.

23. The process in accordance with claim 1, wherein the at least two cutting mechanisms comprise nozzles for discharging a fluid jet.

24. The process in accordance with claim 23, wherein the fluid jet comprises a water jet, and the fluid jet is discharged obliquely to a direction normal of the traveling material web.

25. The process in accordance with claim 1, wherein the traveling material web is composed of a paper web.

26. The process in accordance with claim 1, wherein the target region comprises a target roll.

27. A device for forming a transfer strip for transferring a traveling material web comprising:

at least two cutting mechanisms which are movable relative to the traveling material web in a plane approximately parallel to traveling material web, said at least two cutting mechanisms being positioned to cut a transfer strip that extends approximately parallel to a web travel direction;

said at least two cutting mechanisms being positionable, prior to cutting, at one of a same and different width positions between web edges of the traveling material web, and actuatable to produce at least one resulting cut in the traveling material web;

at least one of the at least two cutting mechanisms being movable toward an edge of the traveling web to form a pointed beginning of a transfer strip, whereby the resulting cuts of the at least two cutting mechanisms occur at one of a same and a substantially close proximity to a same width position, wherein the traveling web is transferred into a target region that comprises a target roll.

28. The apparatus in accordance with claim 27, wherein said at least two cutting mechanisms are movable independently of each other.

29. The apparatus in accordance with claim 27, wherein said at least two cutting mechanisms are positioned with an approximately constant spacing in the web travel direction, and are movable along a common axis cross-wise to the web travel direction.

30. The apparatus in accordance with claim 27, wherein said at least two cutting mechanisms are located on a common carrier which extends across the traveling material web in a cross-wise direction.

31. The apparatus in accordance with claim 27, wherein said at least two cutting mechanisms are rotatable around an axis that extends approximately normal to the traveling material web.

32. The apparatus in accordance with claim 27, wherein said at least two cutting mechanisms comprise at least one nozzle for discharging a fluid jet.

33. The apparatus in accordance with claim 32, wherein the fluid jet comprises a water jet, and the fluid jet is discharged obliquely to a direction normal of the traveling material web.

34. The apparatus in accordance with claim 27, wherein said apparatus forms a component of one of a drying section, a wet section, a coating unit, and an end group of a paper machine.

35. The apparatus in accordance with claim 27, wherein the traveling material web is composed of a paper web.

* * * * *